US008092165B2

(12) United States Patent
Bouchard et al.

(10) Patent No.: US 8,092,165 B2
(45) Date of Patent: Jan. 10, 2012

(54) HP SEGMENT VANES

(75) Inventors: Guy Bouchard, Mont St-Hilaire (CA); Danny Mills, Châteauguay (CA)

(73) Assignee: Pratt & Whitney Canada Corp., Longueuil (CA)

( * ) Notice: Subject to any disclaimer, the term of this patent is extended or adjusted under 35 U.S.C. 154(b) by 1025 days.

(21) Appl. No.: 12/017,077

(22) Filed: Jan. 21, 2008

(65) Prior Publication Data

US 2009/0185899 A1 Jul. 23, 2009

(51) Int. Cl.
*F03B 11/02* (2006.01)

(52) U.S. Cl. ..... 415/209.2; 415/210.1; 29/889.22

(58) Field of Classification Search ..... 415/139, 415/173.1, 202, 208.1, 208.2, 208.5, 209.2, 415/209.3, 210.1, 211.2, 213.1
See application file for complete search history.

(56) References Cited

U.S. PATENT DOCUMENTS

| | | | | |
|---|---|---|---|---|
| 2,755,064 | A | 7/1956 | Simonsen | |
| 2,763,462 | A | 9/1956 | McDowall et al. | |
| 3,521,974 | A | 7/1970 | Zerlauth | |
| 3,970,318 | A * | 7/1976 | Tuley | 277/641 |
| 4,009,969 | A | 3/1977 | Kadera et al. | |
| 4,426,191 | A * | 1/1984 | Brodell et al. | 415/189 |
| 4,585,390 | A | 4/1986 | Pirtle et al. | |
| 4,710,097 | A | 12/1987 | Tinti | |
| 4,832,568 | A | 5/1989 | Roth et al. | |
| 4,990,056 | A | 2/1991 | McClain et al. | |
| 5,211,537 | A | 5/1993 | Langston et al. | |
| 5,236,304 | A | 8/1993 | Charbonnel et al. | |
| 5,319,850 | A | 6/1994 | Charbonnel et al. | |
| 6,296,442 | B1 | 10/2001 | Tran | |
| 6,296,443 | B1 * | 10/2001 | Newman et al. | 415/209.2 |
| 6,425,738 | B1 * | 7/2002 | Shaw | 415/208.1 |
| 6,821,087 | B2 * | 11/2004 | Matsumoto et al. | 415/191 |
| 6,843,638 | B2 | 1/2005 | Hidalgo et al. | |
| 2005/0042085 | A1 * | 2/2005 | Richards | 415/209.3 |

* cited by examiner

*Primary Examiner* — Edward Look
*Assistant Examiner* — Andrew C Knopp
(74) *Attorney, Agent, or Firm* — Norton Rose OR LLP

(57) ABSTRACT

A stator vane segment, for constructing a circumferential array of like segments in a gas turbine engine, each segment in the array being separated by an axially extending joint from an adjacent segment and being releasably mounted to an outer engine casing. Each stator vane segment has: a number of vane airfoils spanning radially between an inner platform and an outer platform, and the outer platform includes: a casing mounting fastener on an outer surface and mating lateral joint edges extending between forward and aft edges.

14 Claims, 6 Drawing Sheets

HP SEGMENT VANES

TECHNICAL FIELD

The present invention relates generally to stator vanes in the compressor and/or turbine section of a gas turbine engine, and methods of mounting same.

BACKGROUND OF THE ART

Both compressor and turbine stator vane assemblies comprise airfoils extending radially across the gas path to direct the flow of gas between forward and/or aft rotating turbines or compressor blades. The stator vane assemblies are mounted to an outer engine casing or other suitable supporting structure which generally defines the outer limit of the gas path and provides a surface to which the outer platforms of the stator vane assembly are connected. Conventional connecting means for mounting the stator vane assemblies to the engine casing include ring structures with hooks or tongue-and-groove surfaces.

Such conventional mounting systems for stator vanes are generally complex castings and thus impose a significant weight penalty on the engine due to the amount of material used for interlocking surfaces and connectors. It is therefore desirable to produce a stator vane array that reduces the weight and complexity of the overall stator vane assembly.

SUMMARY

In accordance with one aspect of the present invention, there is provided a stator vane segment, for constructing a circumferential array of like segments in a gas turbine engine, each segment in the array being separated by an axially extending joint from an adjacent segment and being releasably mounted to an outer engine casing, each stator vane segment comprising: a plurality of vane airfoils spanning radially between an inner platform and an outer platform, wherein the outer platform includes a casing mounting fastener on an outer surface and mating lateral joint edges extending between forward and aft edges thereof.

There is also provided, in accordance with another aspect of the present invention, a stator vane assembly of a gas turbine engine comprising a circumferential array of like stator vane segments separated by an axially extending joints from an adjacent segments, the stator vane segments being releasably mounted to an outer engine casing such that relative circumferentially displacement therebetween due to thermal growth difference is possible, each stator vane segment having a plurality of vane airfoils spanning radially between an inner platform and an outer platform, wherein the outer platform includes a casing mounting fastener on an outer surface and mating lateral joint edges extending between forward and aft edges thereof.

There is further provided, in accordance with another aspect of the present invention, a method of assembling a stator vane assembly within a casing of a gas turbine engine, the method comprising: providing a plurality of vane segments, the vane segments being engageable circumferentially to form the annular stator vane assembly and being free to grow relative to the casing due to thermal growth difference between the casing and the vane segments, each said vane segment having a plurality of vane airfoils extending between inner and outer vane platforms, the outer platform having at least one mounting stud outwardly extending therefrom and overlapping lateral joint edges at opposed end of the outer platform; individually circumferentially mounting each said vane segment to said case by inserting the mounting stud into a mating opening in the casing and interlocking the mating lateral joint edges of the outer platforms of each adjacent vane segment; and fastening the vane segments in place within the casing with a fastener engaged to each of the mounting studs outside of said casing, to thereby form the annular stator vane assembly mounted within said casing.

DESCRIPTION OF THE DRAWINGS

Further features and advantages of the present invention will become apparent from the following detailed description, taken in combination with the appended drawings, in which.

Further details will be apparent from the detailed description included below.

DETAILED DESCRIPTION OF PREFERRED EMBODIMENTS

Figure 1:
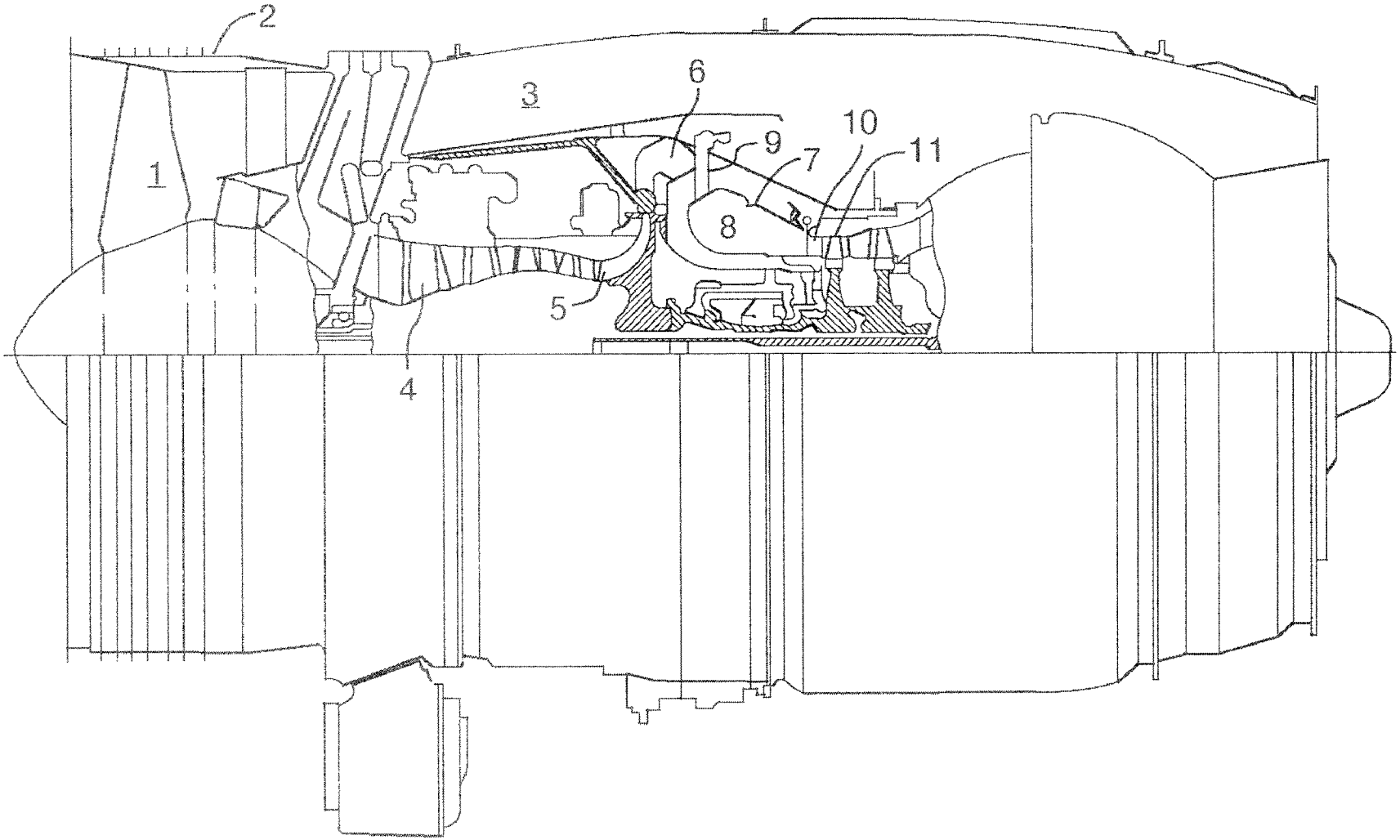
FIG. 1 is a schematic cross-sectional view of a gas turbine engine.

FIG. 1 illustrates a turbofan gas turbine engine of a type preferably provided for use in subsonic flight. It will be understood however that the invention is applicable to any type of gas turbine engine, such as a turboshaft engine, a turboprop engine, or auxiliary power unit. The gas turbine engine generally comprises in serial flow communication a fan 1 through which ambient air is propelled, a multistage compressor for pressurizing the air, a combustor in which the compressed air is mixed with fuel and ignited for generating an annular stream of hot combustion gases, and a turbine section for extracting energy from the combustion gases.

More specifically, air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6. Other engine types include an axial high pressure compressor instead of the centrifugal compressor and diffuser shown. Compressed air is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the stator vane array 10 and turbines 11 before exiting the tail of the engine as exhaust. The stator vane array 10 generally includes compressed air cooling channels when deployed in the hot gas path.

Figure 2:
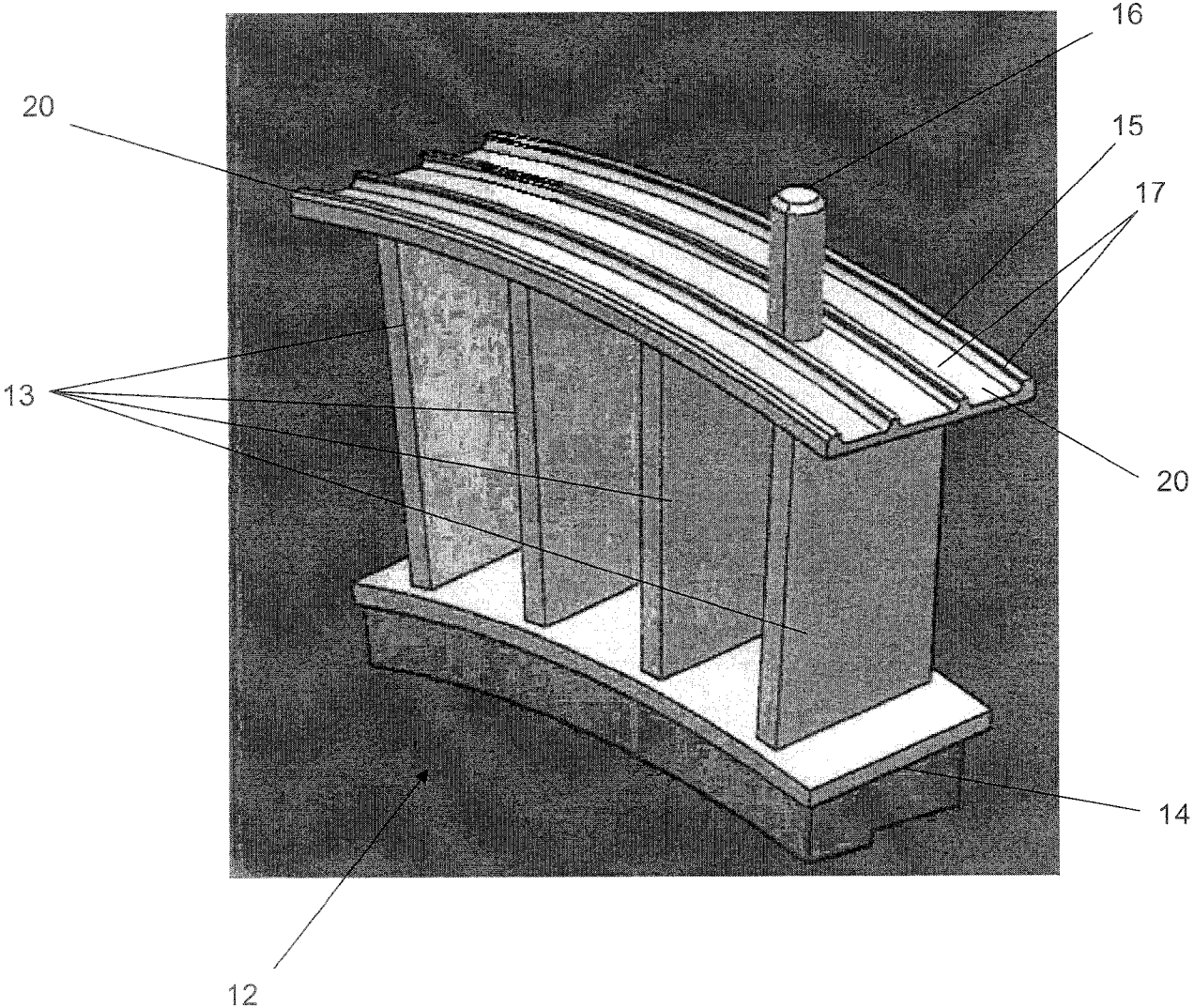
FIG. 2 is a perspective view of a stator segment in accordance with one aspect of the invention, for deployment in the compressor or turbine sections of the gas turbine engine of FIG. 1.
Figure 3:
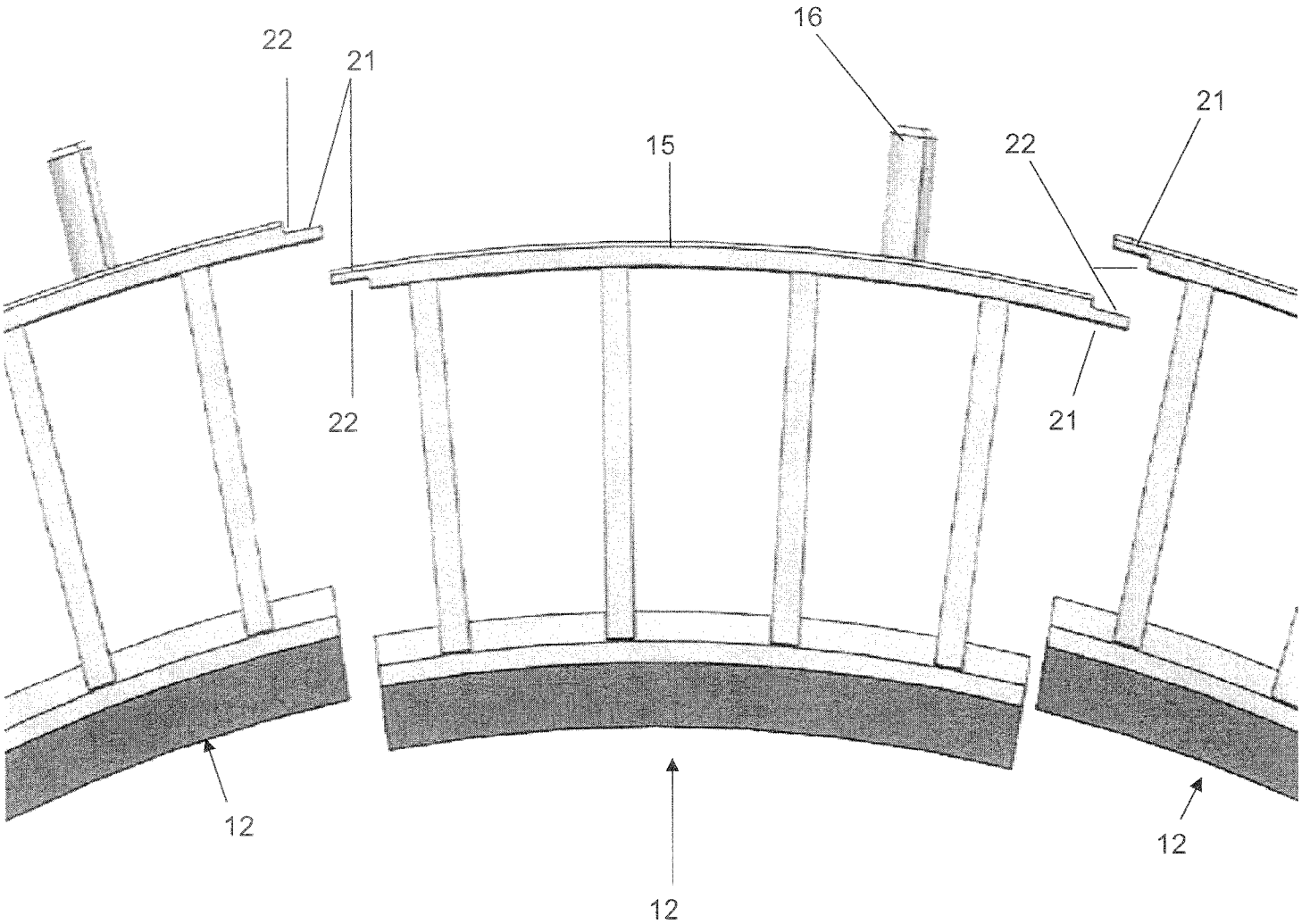
FIG. 3 is a partial, exploded front elevation view of a stator vane ring having several of the vane segments of FIG. 2.
Figure 4:
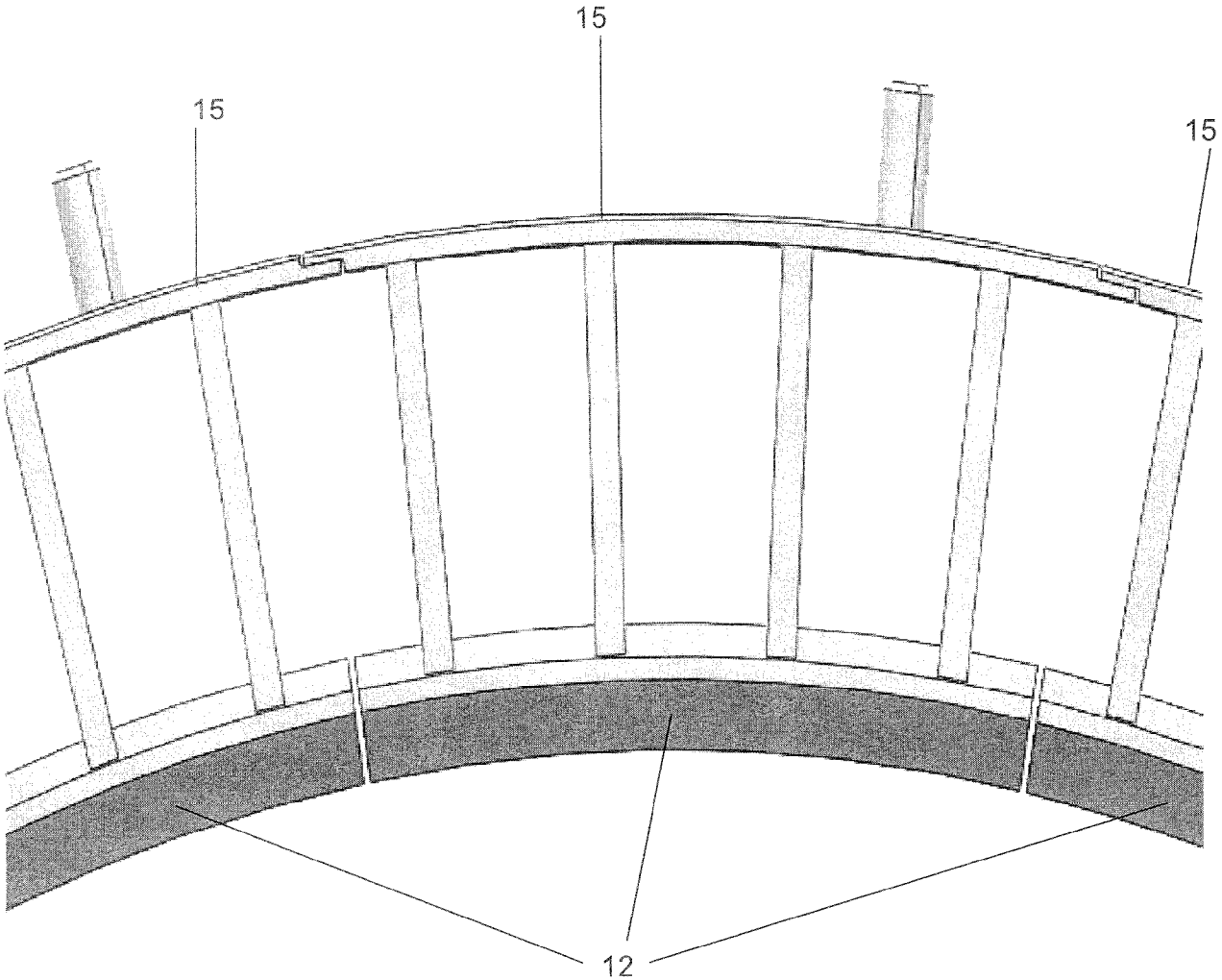
FIG. 4 is a partial front elevation view of the stator vane ring of FIG. 3, wherein the vane segments are circumferentially interconnected in a circumferential array.
Figure 5:
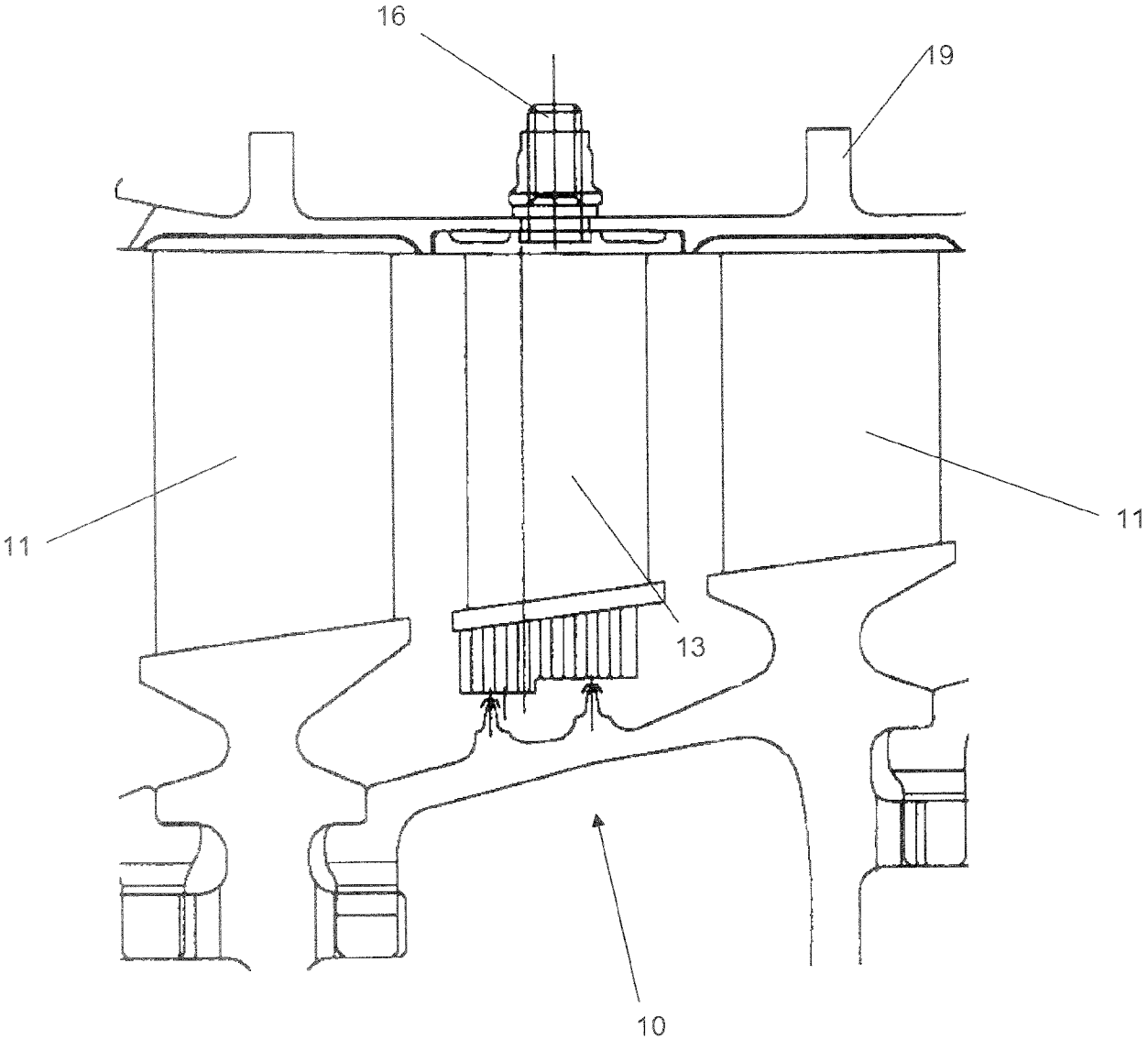
FIG. 5 is a partial axial cross-sectional view of the compressor section of the gas turbine engine, taken through the stator vane ring of FIG. 4 when mounted in place to the outer engine casing.

FIG. 2 shows a single stator segment 12 which in FIG. 1 is shown deployed between rotating turbine blades 11 but can also be deployed in an axial compressor between rotating compressor blades. Each stator vane segment 12 can be assembled together as indicated in FIGS. 3 to 5 to construct a circumferential array of like segments for the gas turbine engine compressor or turbine sections. Each segment 12 in the array is separated in by axially extending joint from an adjacent segment 12 and is releasably mounted to an outer engine casing 19 with threaded stud fasteners 16 in the embodiment illustrated.

Referring to FIG. 2, the stator vane segment 12 has a plurality of vane airfoils 13 that extend radially between the inner platform 14 and the outer platform 15. The outer platform 15 includes a casing mounting fastener 16. In the embodiment shown the casing mounting fastener 16 is a threaded radially extended stud that extends through mating mounting holes 25 in the outer engine casing 19 and is secured thereto with a threaded nut 24 as explained below.

Figure 6:
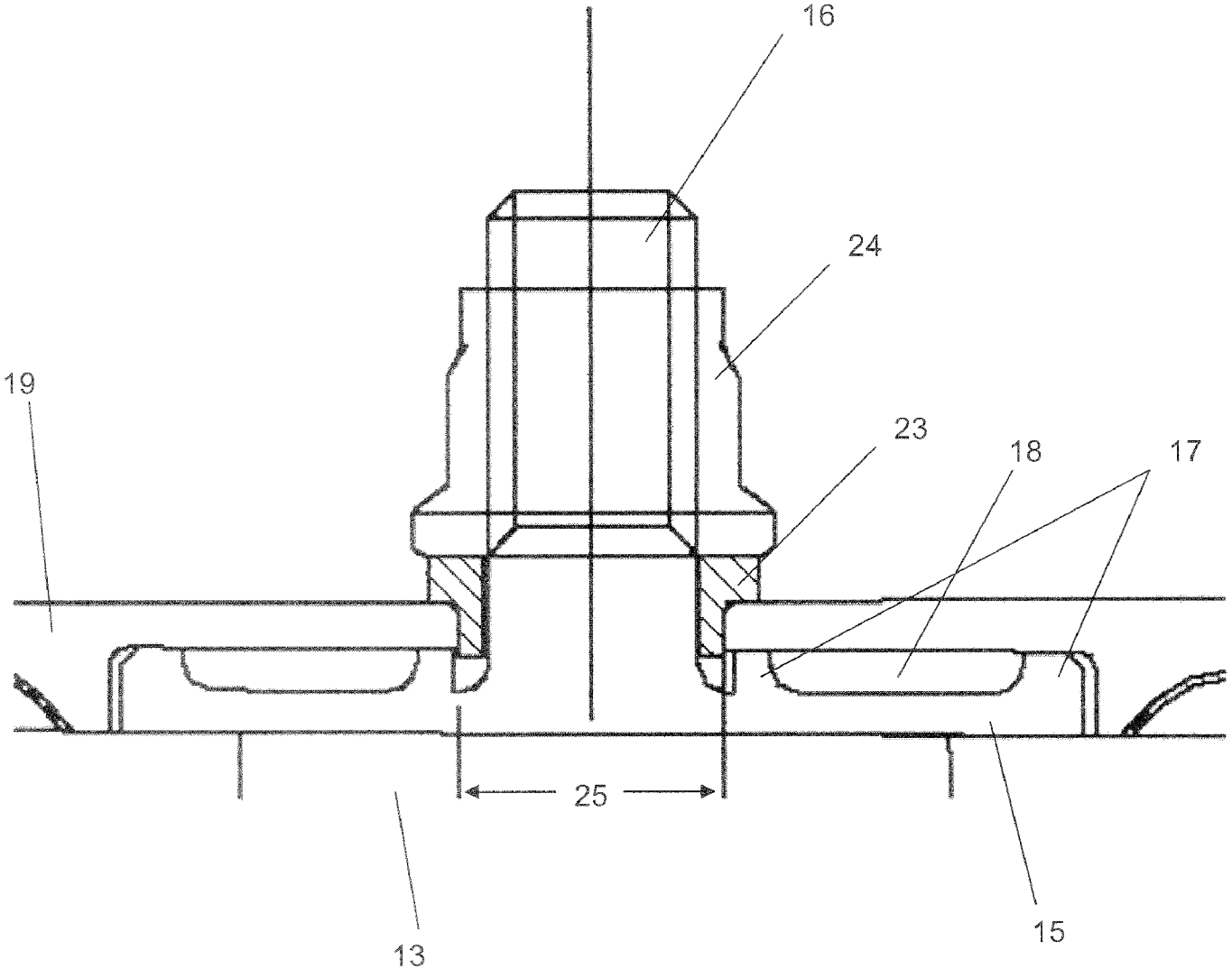
FIG. 6 is a detailed cross-sectional view of the engagement between the outer platform of a vane segment of the stator vane ring of FIG. 5 and the surrounding outer engine casing.

The outer platform 15 includes circumferential ridges 17, as shown in FIG. 6, to provide accurate spacing of the outer platform 15 within a circumferential mounting groove 18 in the outer engine casing 19. The circumferential mounting groove 18 provides a recessed housing for the outer platform 15 and thereby prevents axial motion or rotation through mechanical interference while the outer stud fastener 16 prevents radial displacement and increases frictional retention of the outer platform 15 in the groove 18. The ridges 17 are spaced apart by a circumferential recess in the outer platform and the rib structure serves to lessen the weight of the outer platform 15, and provide for accurate placement in the mounting groove 18. The circumferential recesses between the ridges 17 can serve to channel air flows to enhance air cooling systems.

As shown in FIGS. 2 through 4 the outer platform 15 includes mating lateral joint edges 20 between the forward and aft edges of the outer platform 15.

As indicated in FIGS. 3 and 4 in the embodiment illustrated the mating lateral joint edges 20 have mating tongues 21 and recesses 22. The tongues 21 and recesses 22 define an overlapping joint having a radial thickness equal to the radial thickness of the outer platform 15, best illustrated in FIG. 4. Therefore, as shown in FIG. 4 the assembled outer platforms 15 have a uniform thickness in their mid-portions and in the overlapping joint portion. However, depending on the design requirements, metal casting or machining requirements, the thickness of the platforms 14 and joint areas may vary if increased strength or thermal resistance is required for example.

A simple lap joint is shown in FIGS. 3 and 4 however of course, more complex profiles may also be provided. The lap joint has the advantage of simplicity in manufacturing and assembly. In the embodiment shown, the tongues 21 have a radial thickness that is equal to the radial depth of the recesses 22. However it is within the contemplation of the invention to provide varying thicknesses depending on the design consideration. Further, in the embodiment illustrated the tongues 21 have a circumferential length that is slightly less than the circumferential length of the recesses 22 by a predetermined circumferential gap distance which is best seen in the assembled structure shown in FIG. 4. This circumferential gap is provided to enable assembly, to accommodate manufacturing tolerances as well as to allow for thermal expansion and contraction during operation of the engine, such as relative circumferential displacement between the vane segments caused by thermal growth differential therebetween, for example.

Referring to FIGS. 5 and 6, the casing mounting fastener 16 in the embodiment illustrated comprises a radially extending threaded stud having an outer circumferential cross-sectional dimension which is selected relative to the size of the hole 25 provided in the outer casing 19 to allow sufficient clearance for the assembly procedure indicated best in FIG. 3. A It will be appreciated therefore that in order to enable assembly as indicated in FIG. 3, the clearance between threaded studs 16 and the holes 25 in the engine outer casing 19 must be large enough to permit shifting circumferentially of the individual stator vane segments 12. However, it will also be appreciated that the clearance between the holes 25 and the threaded studs 16 should be minimized to ensure that the segments 12 remain in place during engine operation. In the environment of a gas turbine engine, thermal expansion and contraction as well as severe vibration, retention of the platforms 15 cannot be accurately maintained simply with a threaded stud 16 and threaded nut 24 fastening assembly.

Therefore, as shown in FIG. 6 a sleeve 23 is mounted around the stud 16 and is secured in place with the threaded nut 24 thereby holding the outer platform 15 securely in place within the circumferential mounting groove 18 of the outer engine 19. The sleeve 23 has an inner circumferential cross-sectional dimension that mates the outer circumferential dimension of the stud 16.

Further, the sleeve 23 has an outer circumferential cross-sectional dimension that is greater than the inner circumferential cross-sectional dimension of the sleeve 23 by a difference no less than a circumferential length of the tongue 21. The outer engine casing 19 includes a matching circumferential array of vane segment mounting holes 25 and the casing mounting fastener 16 extends radially from the outer platform 15 through the mounting holes 25.

Therefore, in order to provide enough clearance for the assembly method shown in FIG. 3, where the last segment 12 to be mounted must have sufficient circumferential clearance to enable the tongues 21 to avoid interference with each other, the mounting holes 25 have an inner circumferential dimension that is greater than the outer circumferential cross-sectional dimension than the fastener stud 16 by a difference no less than a circumferential length of the tongues 21.

The releasable sleeve 23 has an outer circumferential cross-sectional dimension mating the inner circumferential dimension of the mounting holes 25. The sleeve 23 has an inner circumferential cross sectional dimension mating the outer circumferential cross-sectional dimension of the fasteners 16. In this manner, the assembly method shown in FIG. 3 can be accomplished since the clearance between the studs 16 and their mounting holes 25 is not less than the circumferential length of the tongues 21. However, to avoid movement of the platforms 15 after assembly during engine operation, the sleeves 23 occupy the clearance space between the holes 25 and the studs 16 and serve to securely maintain the position of the outer platform 15. Further the ridges 17 of the outer platform 15 are retained axially within the mounting groove 18 of the outer engine casing 19.

Although the above description relates to a specific preferred embodiment as presently contemplated by the inventors, it will be understood that the invention in its broad aspect includes mechanical and functional equivalents of the elements described herein.

The invention claimed is:

1. A stator vane segment, for constructing a circumferential array of like segments in a gas turbine engine, each segment in the array being separated by an axially extending joint from an adjacent segment and being releasably mounted to an outer engine casing, each stator vane segment comprising:

a plurality of vane airfoils spanning radially between an inner platform and an outer platform, wherein the outer platform includes a casing mounting fastener on an outer surface and mating lateral joint edges extending between forward and aft edges thereof, the casing mounting fastener including a radially extending stud having an outer circumferential cross-sectional dimension.

2. The stator vane segment in accordance with claim 1 wherein the mating lateral joint edges have interlocking tongue and recessed portions.

3. The stator vane segment in accordance with claim 2 wherein the tongues define an overlapping joint of radial thickness equal to a radial thickness of the outer platform.

4. The stator vane segment in accordance with claim 2 wherein the tongues have a radial thickness equal to a radial depth of the recesses.

5. The stator vane segment in accordance with claim 2 wherein the tongues have circumferential length that is less than a circumferential length of the recesses by a predetermined circumferential gap distance.

6. The stator vane segment in accordance with claim 2 comprising a sleeve about the stud, wherein the sleeve has an inner circumferential cross-sectional dimension mating the outer circumferential cross-sectional dimension of the stud, the sleeve having an outer circumferential cross-sectional dimension greater than the inner circumferential cross-sectional dimension of the sleeve by a difference not less than a circumferential length of the tongues.

7. The stator vane segment in accordance with claim 1 wherein the stud comprises a threaded fastener.

8. A stator vane assembly of a gas turbine engine comprising a circumferential array of like stator vane segments separated by an axially extending joints from an adjacent segments, the stator vane segments being releasably mounted to an outer engine casing such that relative circumferentially displacement between the vane segments due to thermal growth difference is possible, each stator vane segment having a plurality of vane airfoils spanning radially between an inner platform and an outer platform, wherein the outer platform includes a casing mounting fastener on an outer surface and mating lateral joint edges extending between forward and aft edges thereof, the outer engine casing including a circumferential array of vane segment mounting holes and wherein the casing mounting fasteners extend radially from the outer platform and through the mounting holes.

9. The stator vane assembly in accordance with claim 8 wherein the wherein the mounting holes have an inner circumferential cross-sectional dimension greater than an outer circumferential cross-sectional dimension of the fasteners, by a difference not less than a circumferential length of the tongues.

10. The stator vane assembly in accordance with claim 9 wherein each fastener includes a releasable sleeve having an outer circumferential cross-sectional dimension mating the inner circumferential cross-sectional dimension of the mounting holes and having an inner circumferential cross-sectional dimension mating the outer circumferential cross-sectional dimension of the fasteners.

11. The stator vane assembly in accordance with claim 8 wherein the outer engine casing includes a circumferential mounting groove housing the outer platform of the stator vane segments.

12. The stator vane assembly in accordance with claim 8 wherein a circumferential gap is defined between the vane segments, said circumferential gap allowing for said relative circumferentially displacement due to thermal growth differential.

13. The stator vane assembly in accordance with claim 12 wherein said circumferential gap is defined between the outer platforms of adjacent vane segments.

14. A method of assembling a stator vane assembly within a casing of a gas turbine engine, the method comprising:

providing a plurality of vane segments, the vane segments being engageable circumferentially to form the annular stator vane assembly and being free to grow relative to the casing due to thermal growth difference between the casing and the vane segments, each said vane segment having a plurality of vane airfoils extending between inner and outer vane platforms, the outer platform having at least one mounting stud outwardly extending therefrom and overlapping lateral joint edges at opposed ends of the outer platform;

individually circumferentially mounting each said vane segment to said casing by inserting the mounting stud into a mating opening in the casing and interlocking the mating lateral joint edges of the outer platforms of each adjacent vane segment; and fastening the vane segments in place within the casing with a fastener engaged to each of the mounting studs outside of said casing, to thereby form the annular stator vane assembly mounted within said casing.

* * * * *